US005684502A

United States Patent [19]

Fukui et al.

[11] Patent Number: 5,684,502

[45] Date of Patent: Nov. 4, 1997

[54] DRIVING APPARATUS FOR LIQUID CRYSTAL DISPLAY

[75] Inventors: Yasuhito Fukui, Hirakata; Manabu Yumine, Kadoma; Tokikazu Matsumoto, Osaka, all of Japan

[73] Assignee: Matsushita Electric Industrial Co., Ltd., Tokyo, Japan

[21] Appl. No.: 578,390

[22] Filed: Dec. 28, 1995

Related U.S. Application Data

[63] Continuation of Ser. No. 228,893, Apr. 18, 1994, abandoned.

[30] Foreign Application Priority Data

| | | | |
|---|---|---|---|
| Apr. 22, 1993 | [JP] | Japan | 5-095798 |
| Apr. 22, 1993 | [JP] | Japan | 5-95800 |
| Apr. 28, 1993 | [JP] | Japan | 5-102303 |
| May 14, 1993 | [JP] | Japan | 5-112861 |
| May 14, 1993 | [JP] | Japan | 5-112862 |

[51] Int. Cl.[6] ..... G09G 3/36

[52] U.S. Cl. ..... 345/95; 345/99; 345/100

[58] Field of Search ..... 345/87, 88, 89, 345/94, 95, 98, 99, 100, 185, 187, 189, 200, 201, 210; 348/448; 349/33, 34, 36, 39; 382/43

[56] References Cited

U.S. PATENT DOCUMENTS

| | | | |
|---|---|---|---|
| 5,091,784 | 2/1992 | Someya | 345/87 |
| 5,119,084 | 6/1992 | Kawamura et al. | 345/98 |
| 5,124,692 | 6/1992 | Sasson | 345/201 |
| 5,151,976 | 9/1992 | Artieri | 345/200 |
| 5,262,881 | 11/1993 | Kuwata et al. | 345/210 |

FOREIGN PATENT DOCUMENTS

| | | |
|---|---|---|
| 0484969 | 5/1992 | European Pat. Off. . |
| 0507061 | 7/1992 | European Pat. Off. . |
| 6-51717 | 2/1994 | Japan . |

OTHER PUBLICATIONS

"A New Addressing Technique for Fast Responding STN LCD's," (Ruckmongathan et al.) Proceedings of the Twelfth Intern. Display Research conf., Japan Display 1992,; Oct. 1992, pp. 65–68.

Scheffer et al., "Active Addressing Method for High–Contrast Video–Rate STN Display", 1992 SID digest of Technical Papers XXIII, 228–231 (1992).

Clifton et al., "Hardware Architectures for Video–Rate, Active Addressed STN Display", Proceedings 12th International Display Research Conference, 503–506 (1992).

Corner et al., "Pulse–Height Modulation (PHM) Gray Shading Methods for Passive Matrix LCDs", Proceeding 12th International Display Research Conference, 69–72 (1992).

"Active Addressing of STN Displays for High Performance Video Applications", Displays, vol. 14, No. 2, Apr. 1993, Guildform GB; pp. 74 through 85.

"Active Addressing Method for High Contrast Video–Rate STN Displays", 1992 SID International Symposium—Digest of Technical Papers, vol. 23, May 17, 1992.

*Primary Examiner*—Steven Saras

*Attorney, Agent, or Firm*—Greenblum & Bernstein P.L.C.

[57] ABSTRACT

A driving apparatus for a liquid crystal display of a type sandwiching a layer of liquid crystal material capable of responding to a voltage of an effective value applied between row and column electrodes. The apparatus includes an image data buffer memory for storing and outputting a digital image data of one frame, transferred from an external circuit, in the form of an image data matrix; a matrix generator for outputting data having a predetermined orthogonal matrix; a converter for converting the image data with the use of the orthogonal matrix into an converted data matrix and for outputting the converted data matrix; a converted data buffer memory for storing and outputting the converted data matrix; a driver for driving the liquid crystal display in synchronism with a row signal, which applies the orthogonal matrix to the row electrodes of the liquid crystal display, and also a column signal which applies the converted data matrix to the column electrodes of the liquid crystal display.

6 Claims, 12 Drawing Sheets

DRIVING APPARATUS FOR LIQUID CRYSTAL DISPLAY

This application is a continuation of application Ser. No. 08/228,893, filed Apr. 18, 1994, now abandoned.

BACKGROUND OF THE INVENTION 1. (Field of the Invention)

The present invention relates to a driving apparatus for a liquid crystal display utilizing an addressing technique effective to permit a fast responding STN (Super Twisted Nematic) simple matrix type liquid crystal display to provide images of high contrast.

2. (Description of the Prior Art)

The liquid crystal display is nowadays used as one type of flat panel displays, an exemplary type of which is a STN simple matrix type liquid crystal display. As shown in FIG. 1, this STN simple matrix type liquid crystal display is of a simple structure includes a plurality of transparent, stripe-shaped first electrodes formed on a first glass substrate so as to extend in one direction, a corresponding number of similarly transparent, stripe-shaped second electrodes formed on a second glass plate so as to extend in a transverse direction perpendicular to such one direction to thereby form a matrix of row and column electrodes together with the first electrodes, and a layer of liquid crystal material sealingly sandwiched between the first and second glass substrates. Due to this peculiar structure, the STN liquid crystal display has an advantage in that it is inexpensive to make. With the advent of a STN liquid crystal display having a fast responding characteristic and capable of displaying time-varying image of a video-rate, the field of application of this STN liquid crystal display is now expanding.

However, It has been found that the fast responding STN simple matrix type liquid crystal display is susceptible to a considerable reduction in image contrast if it is driven by the use of the conventional driving technique in which a select voltage is applied at a time to one of the row electrodes during one frame period while information to be applied to pixels aligned with such one of the row electrodes is supplied through the column electrodes. To avoid this considerable reduction in image contrast, a new driving technique has been suggested to improve the image contrast exhibited by the STN simple matrix type liquid crystal display by selecting the plural row electrodes simultaneously at a time and selecting a number of times one of the row electrodes during one frame period.

This recently suggested driving technique is shown in will be discussed with reference to FIG. 2. A voltage proportional to a data having a predetermined orthogonal matrix is applied as a row signal to the row electrodes of the STN simple matrix type liquid crystal display. The orthogonal matrix referred to above consists of a data of two binary digits of "1" and "−1" or a data of three binary digits of "1", "0" and "−1", in which the inner product of arbitrarily chosen two different ones of the row vectors forming parts of the matrix or arbitrarily chosen two different ones of the column vector forming parts of the matrix necessarily be zero. Of the data having this matrix, the binary digits "1", "0" and "−1" are taken as Low, Middle and High levels, respectively, and are used as row signals. In other words, a three-digit driver is used for a row driver.

Also, with respect to a digital image data for each frame to be displayed by the liquid crystal display, a product of the digital image date times the orthogonal matrix to be used for driving the row electrodes is determined and is then converted into a converted data. A voltage proportional to the value of each element of the converted data is applied, as a column signal, to the column electrode of the STN simple matrix type liquid crystal display. If the image data is of a multi-step gradation, the converted date correspondingly represents a multi-level data and, therefore, an analog driver is employed for a column driver. In addition, since the use of this driving technique results in an increase of the column voltage of the column signal, it is inevitably necessary to use the column driver having a high breakdown voltage. Thus, when the two signals are applied to the two sets of the electrodes of the liquid crystal display, an effective voltage proportional to each element of the image data is accumulated in the row and column electrodes during one frame period. Since respective portions of the liquid crystal layer aligned with the pixels permit passage of light therethrough in dependence on the effective voltage between the row and column electrodes, an image can be displayed on the liquid crystal display.

This newly suggested driving technique is described by T. J. Scheffer and B. Clifton in "Active Addressing Method for High-Contrast Video-Rate STN Displays" [1992 SID Digest of Technical Papers XXIII, 228–231 (1992)], by B. Clifton and D. Prince in "Hardware Architectures for Video-Rate, Active Addressed STN Displays" [Proceedings 12th International Display Research Conference, 503–506 (1992)] and by A. R. Corner and T. J. Scheffer in "Pulse-Height Modulation (PHM) Gray Shading Methods for Passive Matrix LCDs." (Proceedings 12th International Display Research Conference, 69–72 (1992)].

According to the first listed paper, it is described that the Walsh function as the orthonormal function for the row selection is effective to lower the voltage of the column signal. However, when the Walsh function discussed in this first listed paper is employed, a problem arises in that no high speed computational algorithm for the Hadamard conversion can be used in an arithmetic circuit for computing the column signal.

The second listed paper introduces a specific structure of an arithmetic circuit for computing the column voltage. This arithmetic circuit is of a structure wherein computation is effected for each bit of the digital data. With this arithmetic circuit, a digital data signifying "0" cannot be recognized "0" and no multiplication of it by any other data can be omitted, and therefore, redundancy tends to occur in circuit configuration and computational speed.

The last listed paper discloses the pulse-height modulation which is a method of modulating the column signal for accomplishing a gray shading. Although this last listed paper introduces an equation for calculating the virtual information element, this equation includes a multiplication and a square root and, therefore, a substantial loss occurs in circuit configuration and computational speed if the arithmetic circuit is so structured as to merely perform the equation.

Although not discussed in any one of those papers, some problems are involved in developing liquid crystal displays which operate according to the newly suggested driving technique.

In the first place, when an image corresponding to two fields transmitted according to the interlaced scanning system is non-interlaced to provide a single picture, data for different timings are simultaneously displayed and, therefore, distortion may occur in an edge of a moving object.

In the second place, with the signal processing device based on this newly suggested driving method, computation is carried out to the column vectors of the image date to determine one of the converted data. To describe it with reference to the matrix of the image date shown in FIG. 2, the sequence of reading of each of the image data will be as follows.

$$a_{11} \rightarrow a_{21} \rightarrow a_{31} \rightarrow a_{41} \rightarrow a_{12} \rightarrow a_{22} \rightarrow \ldots \rightarrow a_{44}$$

On the other hand, the sequence of writing of the image data will be as follows since the image data is inputted by means of a raster scanning.

$$a_{11} \rightarrow a_{12} \rightarrow a_{13} \rightarrow a_{14} \rightarrow a_{21} \rightarrow a_{22} \rightarrow \ldots \rightarrow a_{44}$$

In other words, the direction of image data reading and the direction of image data writing are such as shown in FIGS. 3(*a*) and 3(*b*), respectively. Thus, since the image data reading direction and the image data writing direction are different from each other, two buffer memories each capable of holding the image data are required. These buffer memories are alternately operated for each frame period to receive the image data for each row and to output for each column the image data of the previous frame period, respectively.

On the other hand, while each element of the converted data represents an inner product between the column vector of the image data and the row vector of the orthogonal matrix, the row vectors of the orthogonal matrix for each column vector of one of the image data are computed in the sequence from the first row to the last row of the orthogonal matrix and, therefore, the column vectors of the image data are prepared in the following sequence.

$$b_{11} \rightarrow b_{21} \rightarrow b_{31} \rightarrow b_{41} \rightarrow b_{12} \rightarrow b_{22} \rightarrow \ldots \rightarrow b_{44}$$

The converted data so prepared are supplied in units of a single row to the row driver as shown in FIG. 2, and therefore, the sequence of reading is as follows.

$$b_{11} \rightarrow b_{12} \rightarrow b_{13} \rightarrow b_{14} \rightarrow b_{21} \rightarrow b_{22} \rightarrow \ldots \rightarrow b_{44}$$

Accordingly, even in the case of the converted data, each of the buffer memories must have a capacity corresponding to twice the size of the data as is the case with the image data.

Where a color image is desired to be displayed, the image data are supplied after having been decomposed into R (red), G (green) and B (blue) image components. The use of an dedicated arithmetic circuit for the image data of each color, R, G or B, necessarily increases the size of the circuit configuration and, therefore, it is necessary to reduce the circuit configuration by integrating these arithmetic circuits to a single system.

Also, the STN simple matrix type liquid crystal display having a fast responding characteristic of about 150 ms cannot be effectively used as a display device for displaying a time-varying image and has a problem in that afterimages tend to be observed.

SUMMARY OF THE INVENTION

One object of the present invention is to provide a driving apparatus for a liquid crystal display wherein buffer memories for storing the image data and the converted data are employed in the form of a plurality of two-dimensional memories so that data reading and writing can be carried out simultaneously at one address with the direction of access being switched for each frame period to thereby reduce the required capacity of each two-dimensional memory to one half of that hitherto required and wherein, because of the use of the two-dimensional memories, arithmetic circuits for processing the R, G and B image data, respectively, can be integrated into a single system.

Another object of the present invention is to provide the driving apparatus for the liquid crystal display of the type referred to above, wherein computation is carried out by the use of a simplified circuit utilizing a table provided with values of virtual rows so that the arithmetic circuit can be reduced in size.

A further object of the present invention is to provide the driving apparatus for the liquid crystal display of the type referred to above, wherein, without performing computation of the digital data for each bit, a multiplication by a digital data signifying "0" is dispensed with by taking all bits as a real number, thereby reducing the size of the necessary arithmetic circuit.

A still further object of the present invention is to provide the driving apparatus for the liquid crystal display of the type referred to above, wherein the image data corresponding to one field transmitted according to the interlaced scheme is displayed during one field period by displaying the data for one row in two rows, thereby to avoid any possible distortion of the edge of the moving object.

A still further object of the present invention is to provide the driving apparatus for the liquid crystal display of the type referred to above, wherein when the Walsh function is employed, the order of the rows of the image data is changed to make it possible to use a high speed computational method of Hadamard conversion, thereby reducing the size of the required arithmetic circuit.

A still further object of the present invention is to provide the driving apparatus for the liquid crystal display of the type referred to above, wherein a filter for emphasizing a high frequency region of the time-dependent frequency component of the time-varying image data is employed to virtually improve the response of the STN simple matrix type liquid crystal display to thereby eliminate an afterimage phenomenon.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which:

FIG. 10(*b*) is a circuit block diagram showing the details of a converted data buffer memory employed in the first embodiment shown in FIG. 4;

DETAILED DESCRIPTION OF THE EMBODIMENTS

Figure 4:
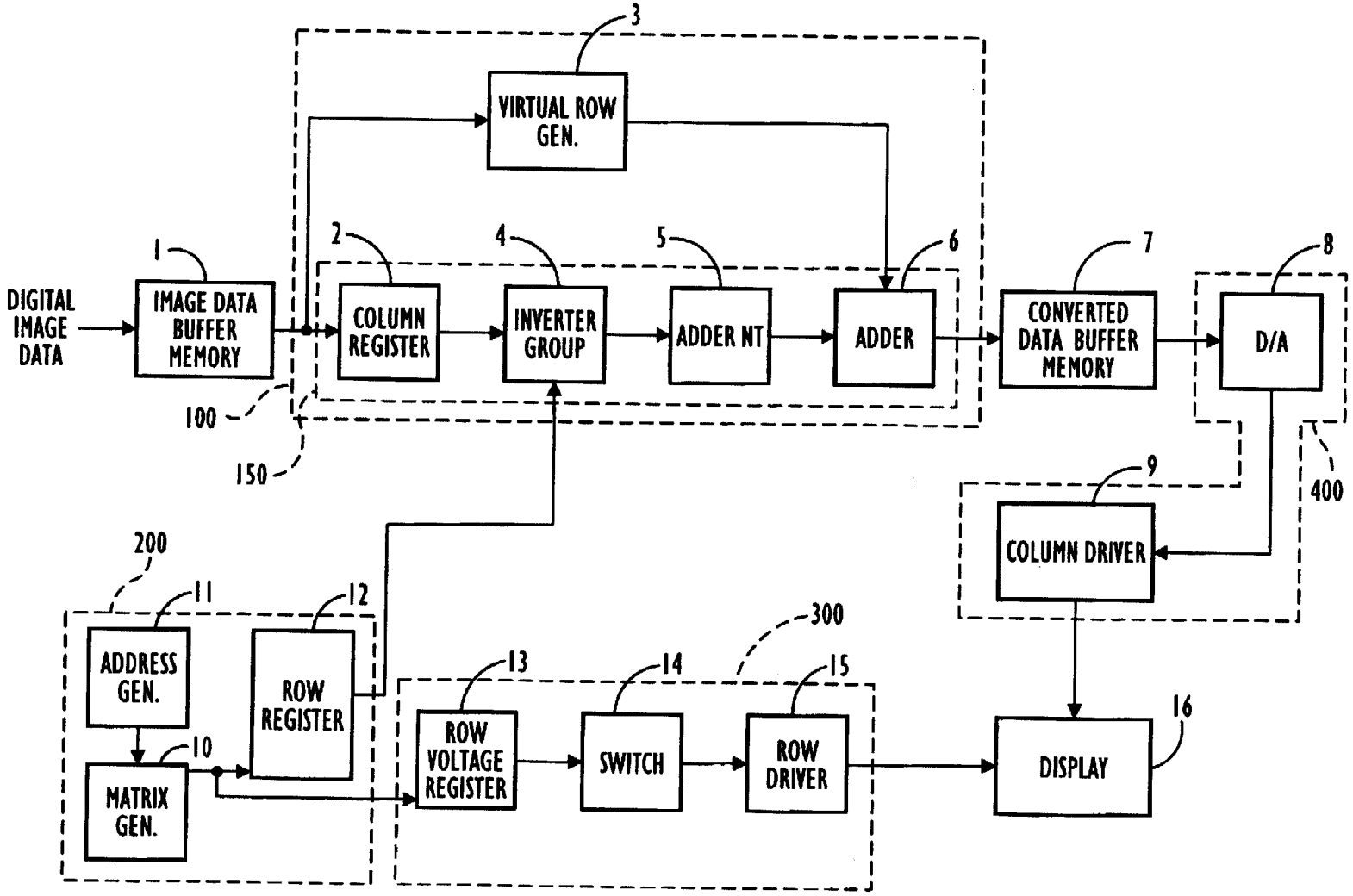
FIG. 4 is a circuit block diagram showing a first embodiment of the present invention.

A driving apparatus for the simple matrix type liquid crystal display according to the present invention will be described in connection with preferred embodiments thereof with reference to the accompanying drawings. FIG. 4 illustrates a circuit block diagram of the driving apparatus according to the first embodiment of the present invention.

Referring now to FIG. 4, an image data buffer memory 1 temporarily stores, in the form of a matrix $A_1$, an image data supplied from an external circuit and corresponding to one field (L rows and M columns. M represents a natural number and L represents a natural number smaller than $N_1$.) and then sequentially outputs a column vector of the matrix $A_1$. This image data is a digital data of D bits (D represents a natural number equal to or greater than 2.) in which a single data corresponds to a value from "1" to "−1". A column register 2 sequentially loads and then latches data of the column vectors of the matrix $A_1$ outputted from the image data buffer memory 1. A matrix memory 10 stores all data of an orthogonal matrix $H_1$ of $N_1$ rows and $N_1$ columns ($N_1$ representing a natural number) which take two digits of "1" and "−1". Specifically, the matrix memory 10 stores all data as a logic Low when they take the value of "1", but as a logic High when they take the value of "−1". An address generating circuit 11 reads out a data written at a specific address in the matrix memory 10 when such address is specified. A row register 12 temporarily stores a data of one row of the matrix $H_1$ read out from the matrix memory 10. In the description which follows, it is assumed that the row register 12 stores a data of the i-th row vector (i representing a natural number equal to or smaller than $N_1$) of the matrix $H_1$ while the column register 2 stores a data of the j-th column vector (j representing a natural number equal to or smaller than M) of the matrix $A_1$.

Figure 1:
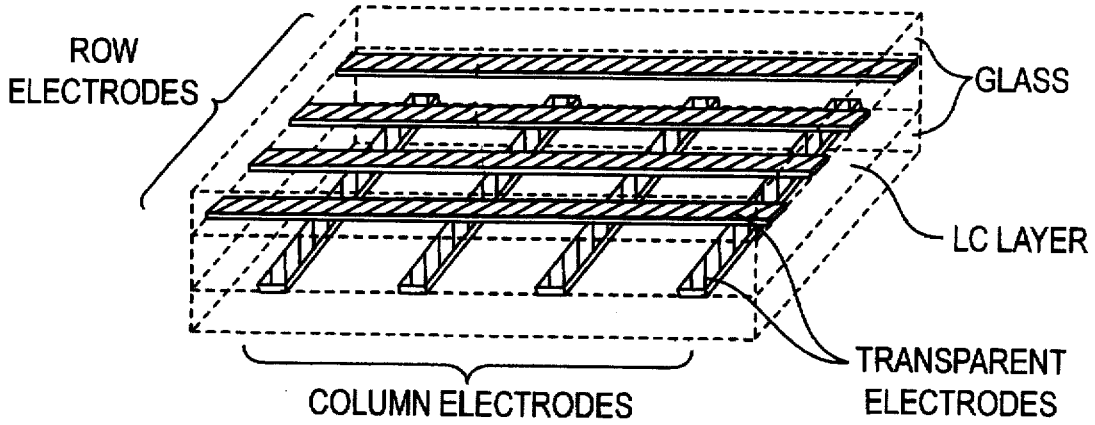
FIG. 1 PRIOR ART
FIG. 1 is a schematic perspective view of the STN simple matrix type liquid crystal display.
Figure 2:
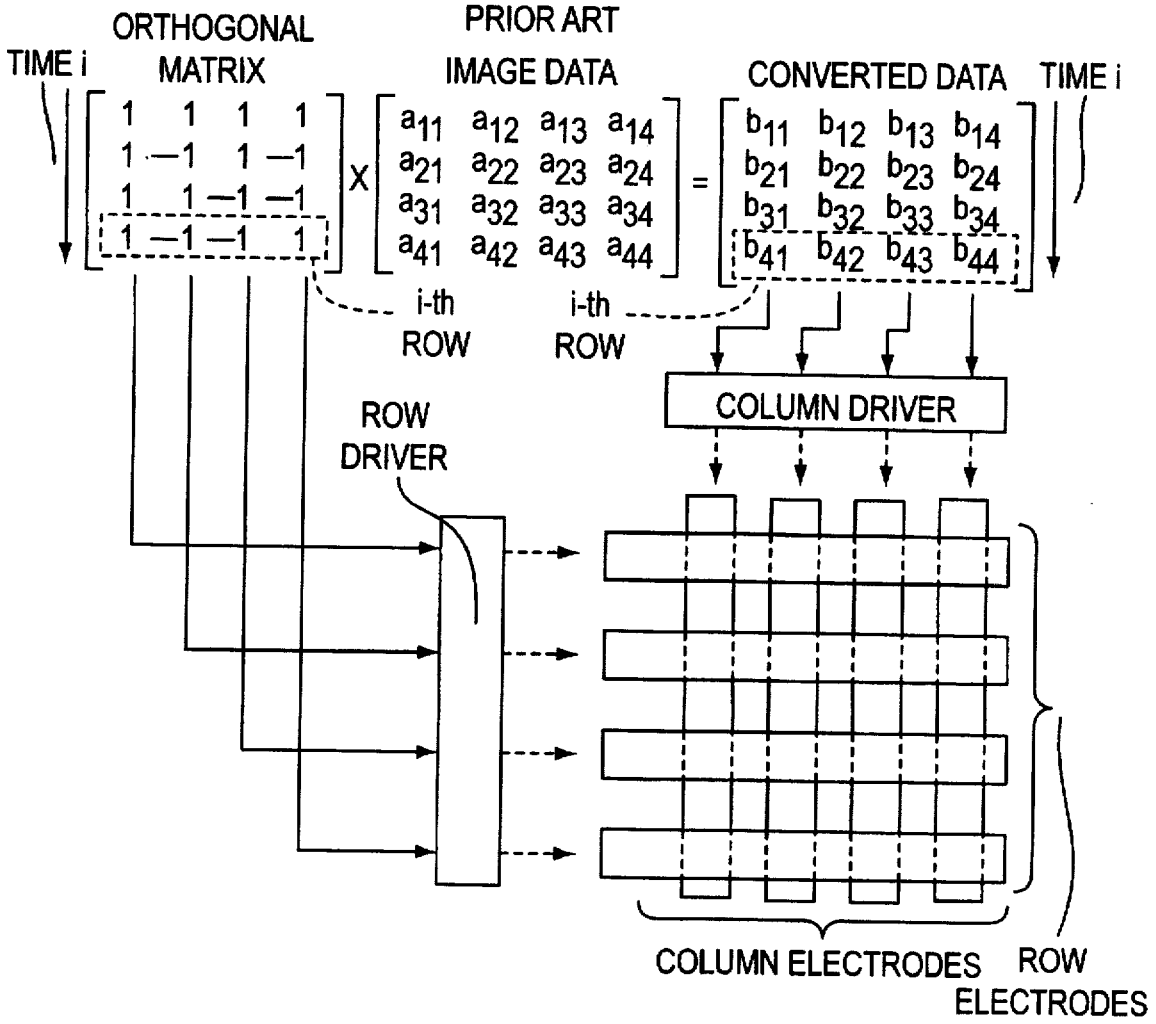
FIG. 2 PRIOR ART
FIG. 2 is a schematic diagram showing a concept of the driving method in which a plurality of rows are selected simultaneously.
Figure 3:
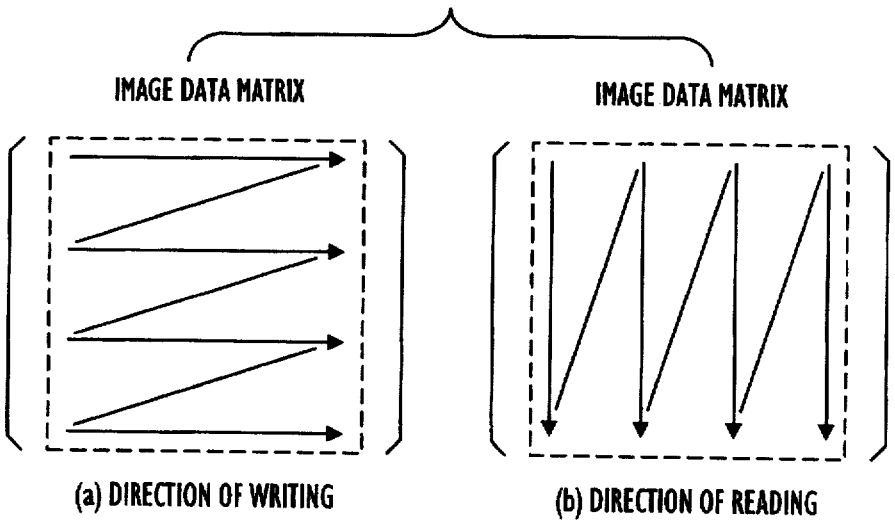
FIGS. 3(*a*) and (*b*) are schematic diagrams showing respective directions of writing and reading image data, respectively, which take place during the practice of the driving method in which the plural rows are selected simultaneously.
Figure 5:
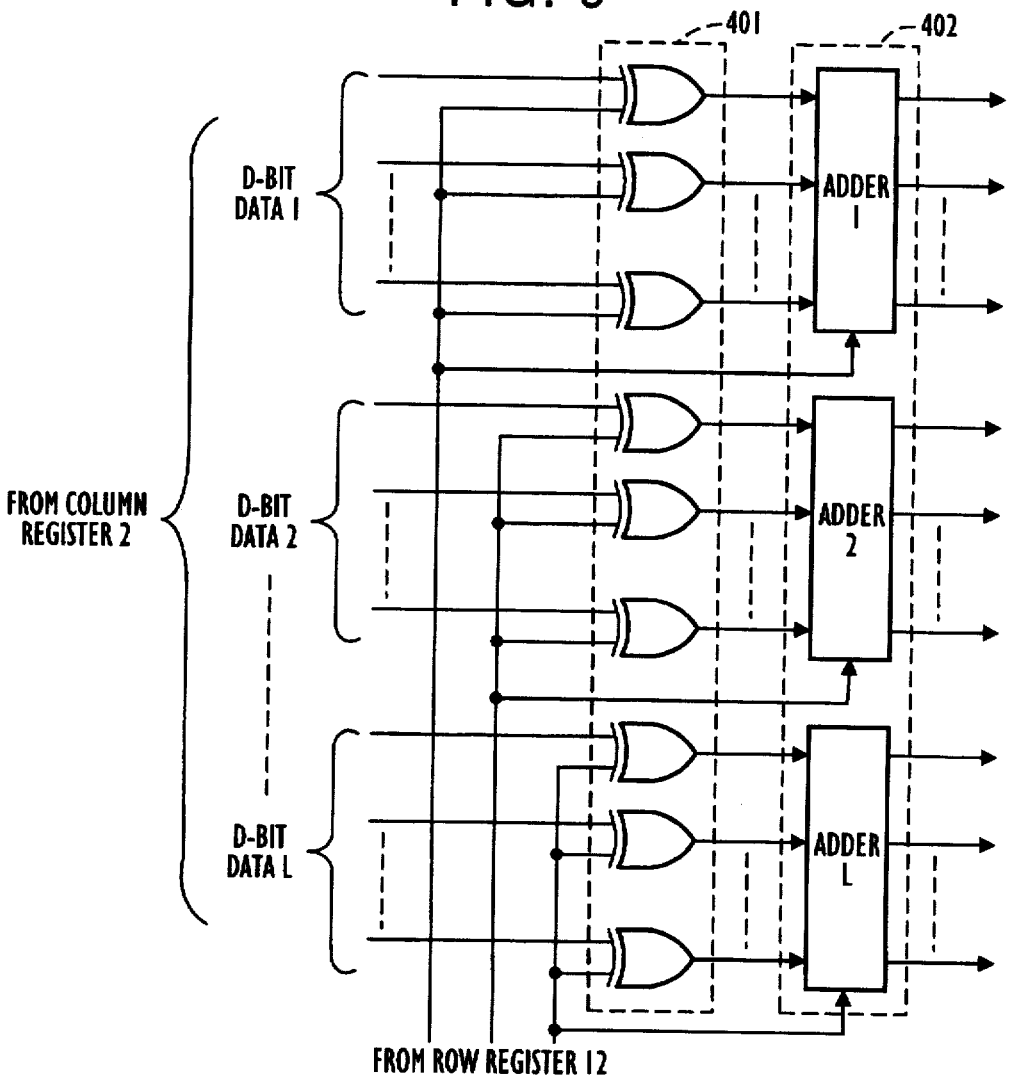
FIG. 5 is a circuit block diagram showing an inverter group employed in the first embodiment shown in FIG. 4.

A virtual row forming circuit 3 calculates, for each column, a value necessary to adjust the sum of squares of the data for one column to a single constant for all columns and then add the virtual row to the last row of the matrix $A_1$. An inverter group 4 comprises, as shown in FIG. 5, an XOR array 401 including D×L XOR gates and an adder group 402 including L adders and is operable to calculate a complemental number of 2 of the k-th digital data (k representing a natural number equal to or smaller than L) of D bits of the column register 2 only when the k-th data of the row register 12 is "−1", i.e., a logic High, and then to output it after having reversed the sign thereof. In other words, it corresponds to a calculation of the product between the k-th data of the row register 12 and the k-th data of the column register 2.

Figure 6:
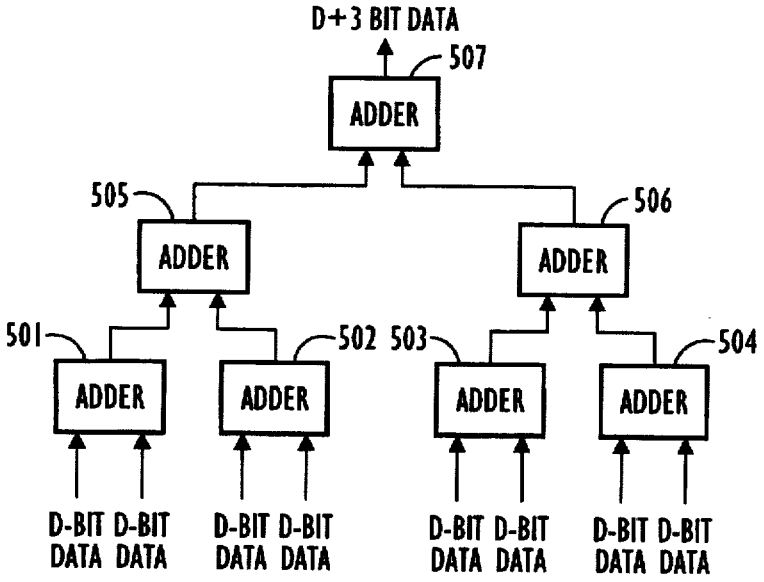
FIG. 6 is a circuit block diagram showing an adder network employed in the first embodiment shown in FIG. 4.

An adder network 5 repeats (L−1) times a computation, by which each neighboring data of the L D-bit data outputted from the inverter group 4 are summed together to provide a single data, until the single data is finally obtained and then outputs the total of output data outputted from the inverter group 4. FIG. 6 illustrates an example of the adder network 5 in which L is 8. Referring to FIG. 6, adders 501 to 504 constitute a D-bit+D-bit adder circuit; adders 505 and 506 constitute a (D+1)-bit+(D+1)-bit adder circuit; and an adder 506 constitutes a (D+2)-bit+(D+2)-bit adder circuit. If the data inputted is of D bits, the data outputted is (D+3) bits.

An adder 6 is operable to sum together the output data of the virtual row forming circuit 3 and the output data of the adder network 5. However, since the $N_1$-th column data of the matrix $H_1$ is such that "1" and "−1" alternate with each other, outputting of the output data of the virtual row forming circuit 3 with its sign alternately reversed, corresponds to a virtual expansion of the matrix $A_1$ to a matrix having $N_1$ rows with information on the virtual row treated as the $N_1$-th row data of the matrix $A_1$. Also, the operation of the adder 6 corresponds to that, when $N_1$ is equal to or greater than L+2, data from the (L+1)-th row to the ($N_1$−1) -th row are regarded "0" and any computation of these "0"s with other data is omitted. Output data from the adder 6 are supplied to a converted data buffer memory 7 and stored temporarily therein in the form of a data of a matrix $B_1$ corresponding to the product between the matrix $H_1$ and the matrix $A_1$.

On the other hand, the simple matrix type liquid crystal display 15 is a simple matrix type liquid display having (2×L) rows and M columns. A row voltage register 13 is a shift register having (2×$N_1$) bits and is operable to load data for the i-th row of the matrix $H_1$ at a timing i which corresponds to one field period divided equally by $N_1$, but to load the single output data of the matrix memory 10 two times since the operating speed thereof is twice the speed at which output data of the matrix memory 10 switches. In other words, the K-column data of the matrix $H_1$ is stored at the (2×k−1)-th and (2×k)-th bits of the row voltage register 13.

Figure 7:
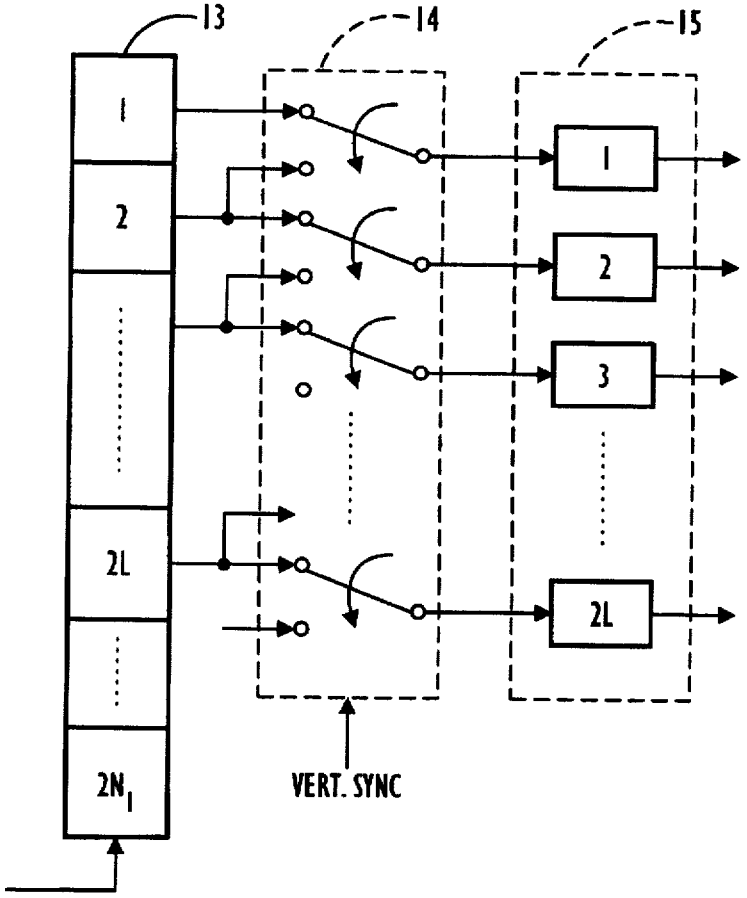
FIG. 7 is a block diagram showing a concept of the driving method in which the plural rows are simultaneously selected when a row drive block is employed in the first embodiment shown in FIG. 4.

A switch 14 is, as shown in FIG. 7, comprised of (2×L) switches which operate in response to a vertical synchronizing signal. More specifically, these switches forming the switch 12 are switched to a lower position, as viewed in FIG. 7, in response to a vertical synchronizing signal applied during an odd-numbered field, but to an upper position as viewed in FIG. 7 in response to a vertical synchronizing signal applied during an even-numbered field.

In other words, during the odd-numbered field, a row driver 15 applies a voltage, corresponding to the data of the second bit to the (2×L+1)-th bit of the row voltage register 14, to the (2×L) row electrodes of the simple matrix type liquid crystal display 16, but during the even-numbered field, the row driver 15 applies a voltage, corresponding to the first bit to the (2×L)-th bit of the row voltage register 14 to the (2×L) row electrodes of the simple matrix type liquid crystal display 16.

A converted data buffer memory 7 is operable to supply to a digital-to-analog (D/A) converter 8 all data of the matrix $B_1$ in the order from an intersection between the first row and the first column to the intersection between the first row and the M-th column and then down to the $N_1$-th row, which converter 8 subsequently converts the digital values, sequentially supplied from the converted data buffer memory 7, into corresponding analog values and then output those analog values. A column driver 9 is operable to apply to the M column electrodes of the simple matrix type liquid crystal display 16 voltages proportional to the analog values corresponding to the M data at the i-th row of the matrix $B_1$ which have been converted by the D/A converter 8 at a timing i.

Of these various component parts, the column register 2, the inverter group 4, the adder network 5 and the adder 6 altogether constitute an arithmetic block 150 for performing a multiplication and a summation; the virtual row forming circuit 3 and the arithmetic block 150 altogether constitute a conversion block 100 for converting the matrix $A_1$ into the matrix $B_1$; the matrix memory 10, the address generating circuit 11 and the row register 12 altogether constitute a matrix generating block 200; the row voltage register 13, the switch 14 and the row driver 15 altogether constitute a row driving block 300 for driving the row electrodes of the simple matrix type liquid crystal display 16; and the D/A converter 8 and the column driver 9 altogether constitute a column driving block 400 for driving the column electrodes of the simple matrix type liquid crystal display 16.

Figure 8:
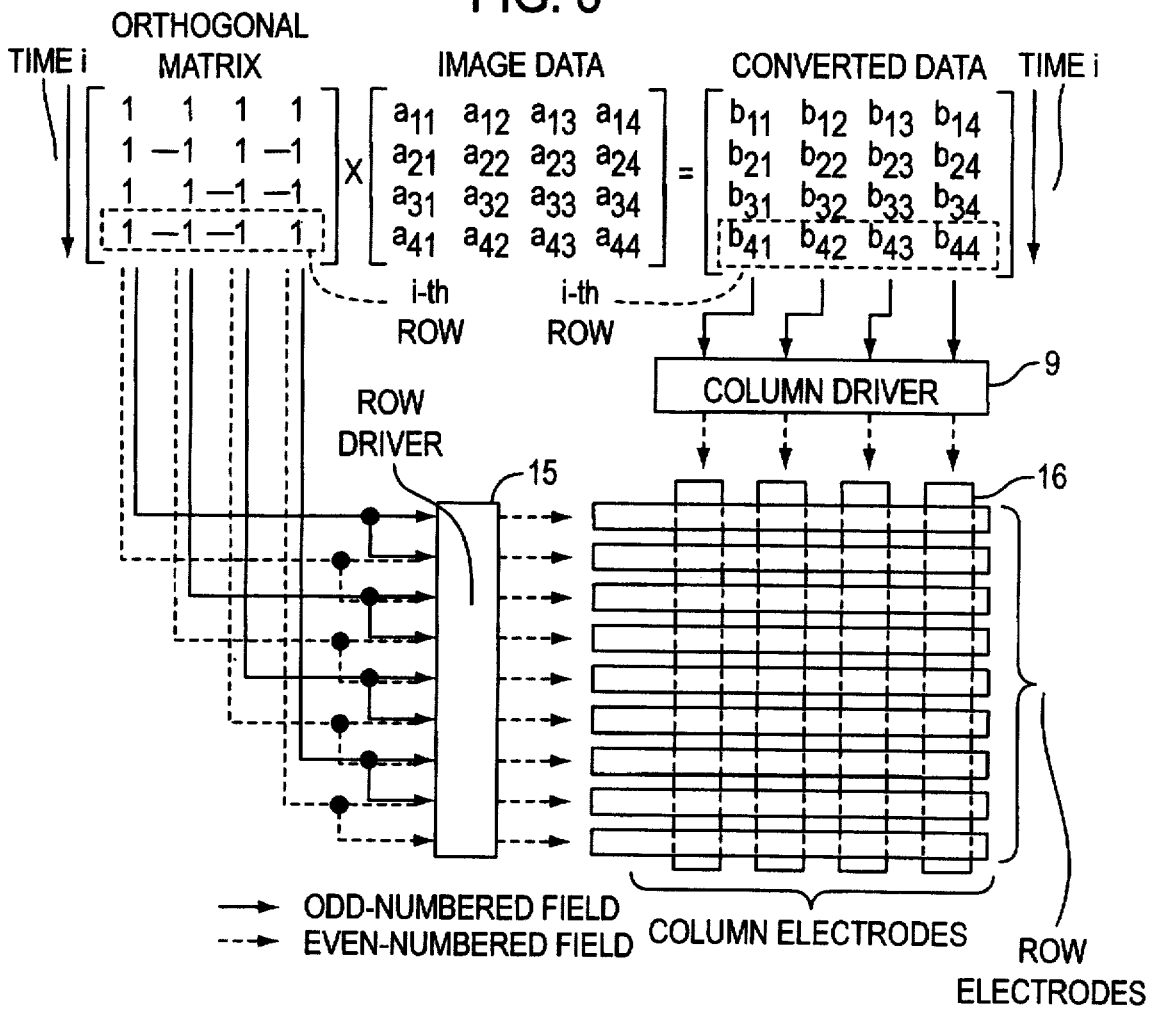
FIG. 8 is a block diagram showing the details of a switch employed in the first embodiment shown in FIG. 4.

FIG. 8 illustrates a method of driving the STN simple matrix type liquid crystal display which can be employed when these component parts as discussed above are employed. The image data and the converted data both shown in FIG. 8 are those corresponding to one field. As shown in FIG. 8, although the neighboring row electrodes of the liquid crystal display are driven by the same row signal, the same row signal is applied to drive, during the even-numbered field, each neighboring row electrodes displaced every row with respect to those during the odd-numbered field. When an image corresponding to one frame is displayed by the simple matrix type liquid crystal display according to the driving method shown in FIG. 8, the resolution may be lowered since the data for one row is displayed over two rows, but no distortion of an edge of a moving object such as observed when the images corresponding to two fields transmitted according to the interlaced scheme are merged together is observed.

The nature of the matrix $H_1$ will now be described. Supposing the circulant Hadamard matrix $H_0$ of $N_1$ orders which is an orthogonal matrix having data consisting of two digits "1" and "−1", the circulant Hadamard matrix $H_0$ may be considered a circulant matrix of $(N_1-1)$ orders except for each of the first row and the first column which contain only "1". By reversing the sign of every other data of the matrix $H_1$ with respect to any of the direction of the rows and that of the columns, a new matrix is formed. By way of example, the circulant Hadamard matrix shown in the following equation (1) can result in a new matrix shown in the following equation (2).

$$H_0=\begin{bmatrix} -1 & 1 & 1 & -1 & 1 & -1 & -1 & 1 \\ 1 & 1 & -1 & 1 & -1 & -1 & -1 & 1 \\ 1 & -1 & 1 & -1 & -1 & -1 & 1 & 1 \\ -1 & 1 & -1 & -1 & -1 & 1 & 1 & 1 \\ 1 & -1 & -1 & -1 & 1 & 1 & -1 & 1 \\ -1 & -1 & -1 & 1 & 1 & -1 & 1 & 1 \\ -1 & -1 & 1 & 1 & -1 & 1 & -1 & 1 \\ 1 & 1 & 1 & 1 & 1 & 1 & 1 & 1 \end{bmatrix} \quad (1)$$

$$H_1=\begin{bmatrix} -1 & -1 & 1 & 1 & 1 & 1 & -1 & -1 \\ -1 & 1 & 1 & 1 & 1 & -1 & 1 & 1 \\ 1 & 1 & 1 & 1 & -1 & 1 & 1 & -1 \\ 1 & 1 & 1 & -1 & 1 & 1 & -1 & 1 \\ 1 & 1 & -1 & 1 & 1 & -1 & -1 & -1 \\ 1 & -1 & 1 & 1 & -1 & -1 & -1 & 1 \\ -1 & 1 & 1 & -1 & -1 & -1 & -1 & -1 \\ -1 & 1 & -1 & 1 & -1 & 1 & -1 & 1 \end{bmatrix} \quad (2)$$

The matrix $H_1$ so obtained is still an orthogonal matrix in which, in a similar manner to the first row and the first column of the matrix $H_0$, none of the rows and the columns of the matrix $H_1$ contain data of the same value, and therefore, the voltage of the column signal can be lowered.

The virtual row forming circuit 3 performs a computation using the value of each virtual row, more specifically the following equation (3). If the computation is carried out as stipulated in the equation (3), the circuit configuration will become large and, therefore, the virtual row forming circuit 3 is so constructed as shown in FIG. 9 to simplify the computation.

$$a_{Nj}=\left(N_i-\sum_{K=1}^{L} a_{kj}^2\right)^{\frac{1}{2}} \quad (3)$$

Figure 9:
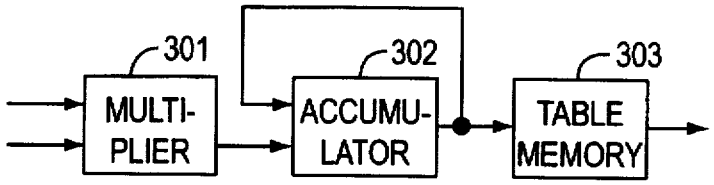
FIG. 9 is a circuit block diagram showing a virtual row forming circuit 3 employed in the first embodiment shown in FIG. 4.

Referring now to FIG. 9, a multiplier circuit 301 calculates the square of one image data supplied from the image data buffer memory 1 while an accumulator circuit 302 accumulates an output data from the multiplier circuit 301 to calculate the sum of the squares of the image data for one row. A table memory 303 stores value of virtual rows corresponding to the sum of the squares of the image data for one row and the data from the table memory 303 is read out by the use of an output data from the accumulator circuit 302.

Figure 10A:
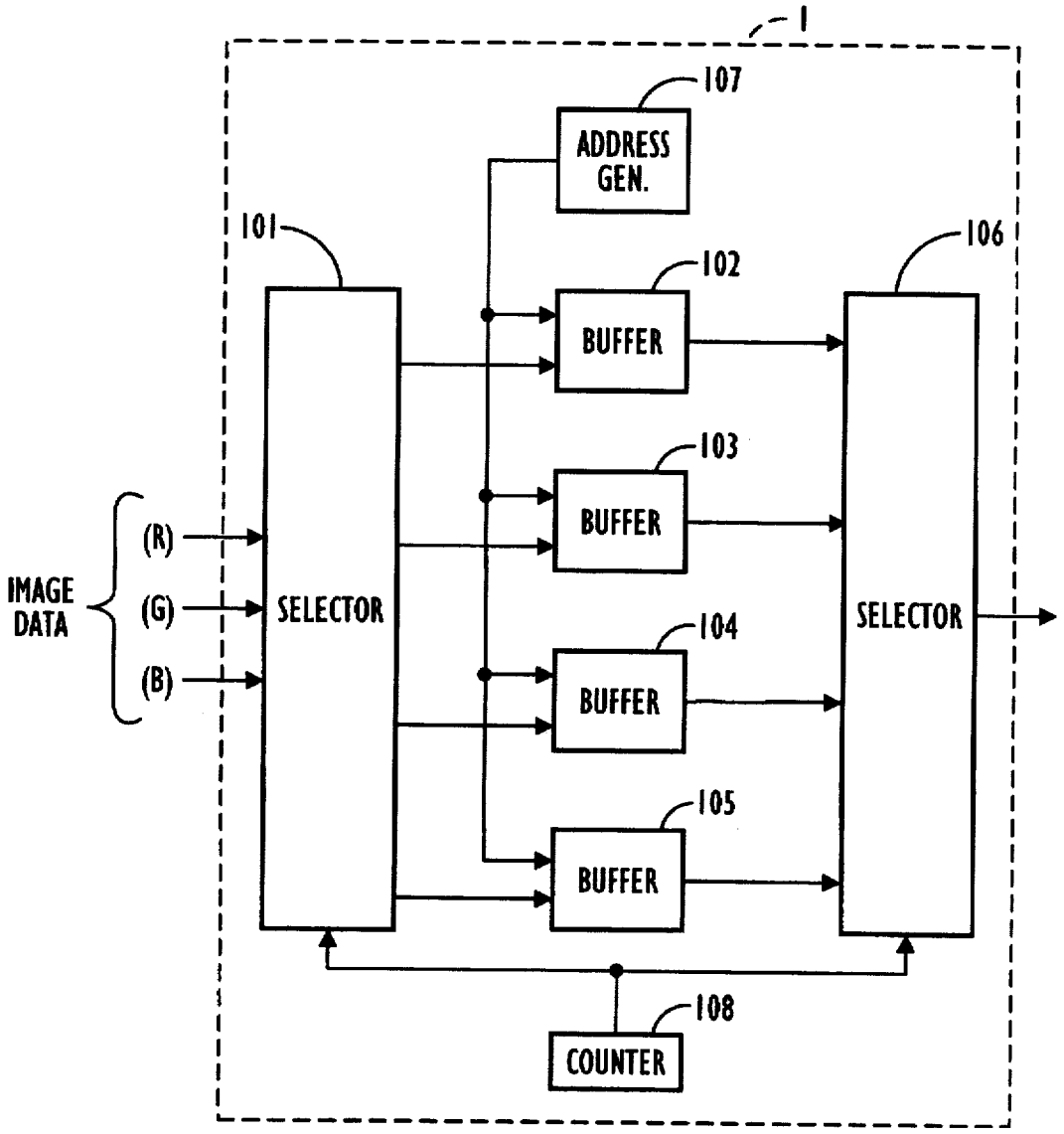
FIG. 10(*a*) is a circuit block diagram showing the details of an image data buffer memory employed in the first embodiment shown in FIG. 4.
Figure 10B:
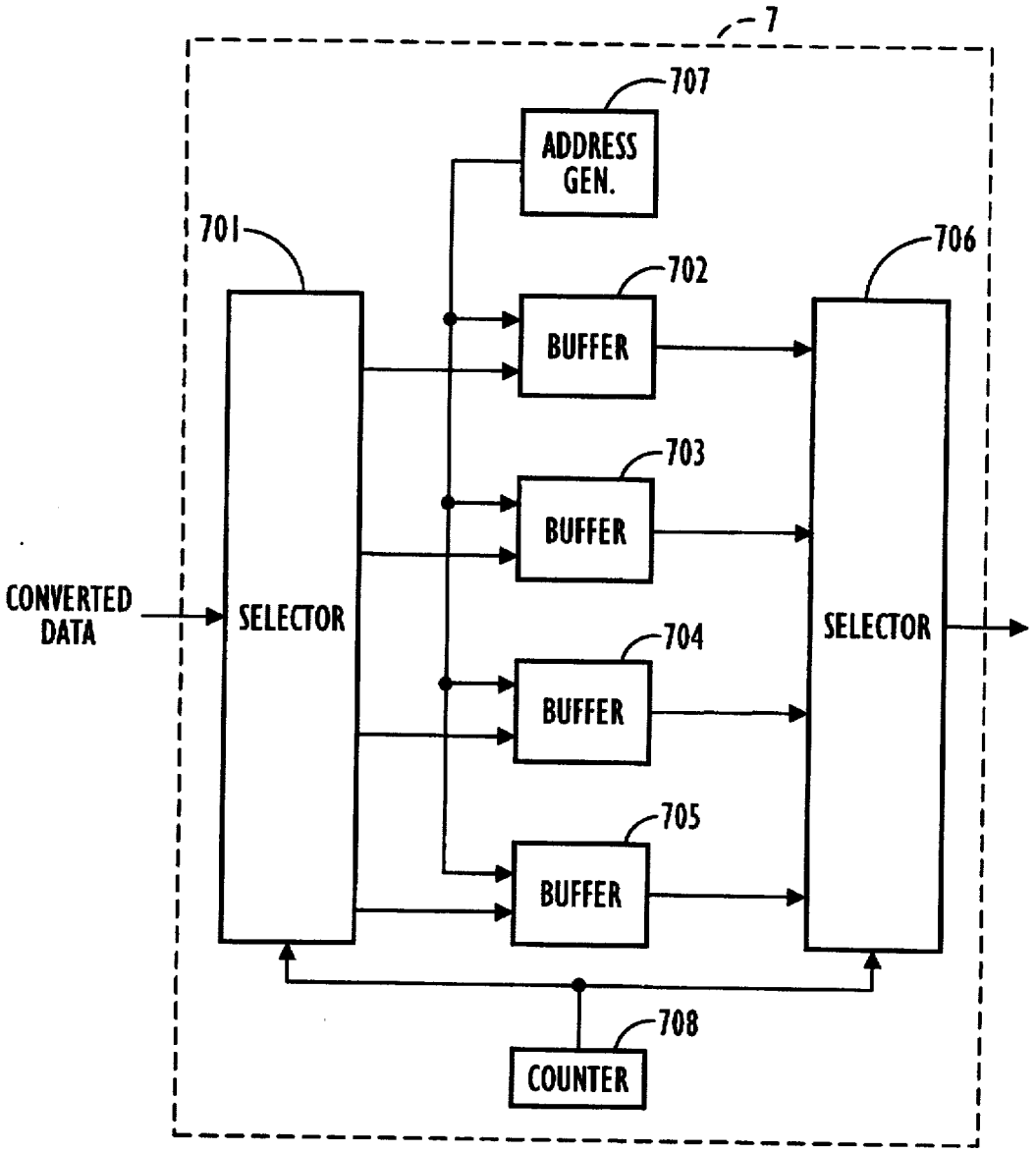

Also, the respective operation of the image data buffer memory 1 and the converted data buffer memory 7 will now be described with reference to FIGS. 10(*a*) and 10(*b*). Referring first to FIG. 10(*a*), the image data inputted to a selector are transferred by raster scanning and, assuming that they have been separated into R, G and B data each having a matrix of three rows and four columns, the R, G and B data can be expressed by the following equations (4), (5) and (6), respectively.

$$Rimage=\begin{bmatrix} r11 & r12 & r13 & r14 \\ r21 & r22 & r23 & r24 \\ r31 & r32 & r33 & r34 \end{bmatrix} \quad (4)$$

$$Gimage=\begin{bmatrix} g11 & g12 & g13 & g14 \\ g21 & g22 & g23 & g24 \\ g31 & g32 & g33 & g34 \end{bmatrix} \quad (5)$$

-continued $$Bimage = \begin{bmatrix} b11 & b12 & b13 & b14 \\ b21 & b22 & b23 & b24 \\ b31 & b32 & b33 & b34 \end{bmatrix} \quad (6)$$

In the following description, the operation in which the data are transferred by means of an ordinary method such as a raster scanning technique will be referred to as a horizontal scanning while the operation in which the data are transferred with the vertical and horizontal directions reversed relative to those in the ordinary method will be referred to as a vertical scanning.

A counter 108 outputs 0 to 3 repeatedly to the selector 101. Based on the output data from the counter 108, the selector 101 selects two-dimensional buffer memories 102, 103, 104 and 105 and then outputs the input data to the selected two-dimensional buffer memories. Each of the two-dimensional buffer memories 102 to 105 has a memory area of three rows and three columns and, before the data are written at a specified address, the data stored at such specified address are read out. An address generating circuit 107 generates an address necessary to permit the horizontal and vertical scannings to be repeated in the two-dimensional buffer memories for each field. A selector 106 operates, based on the output data from the counter 108, to select the two-dimensional buffer memories 102 to 105 and to cause output data to be outputted from the selected two-dimensional buffer memories.

As a result, the three image data so inputted are inputted to the image data buffer memory 1 in the form of one image data expressed by the following equation (7) and are transferred to the two-dimensional buffer memories 102 to 105 in the form of respective data expressed by the following equations (8), (9), (10) and (11).

$$Im = \begin{bmatrix} r11 & g11 & b11 & r12 & g12 & b12 & r13 & g13 & b13 & r14 & g14 & b14 \\ r21 & g21 & b21 & r22 & g22 & b22 & r23 & g23 & b23 & r24 & g24 & b24 \\ r31 & g31 & b31 & r32 & g32 & b32 & r33 & g33 & b33 & r34 & g34 & b34 \end{bmatrix} \quad (7)$$

$$Im_1 = \begin{bmatrix} r11 & g12 & b13 \\ r21 & g22 & b23 \\ r31 & g32 & b33 \end{bmatrix} \quad (8)$$

$$Im_2 = \begin{bmatrix} g11 & b12 & r14 \\ g21 & b22 & r24 \\ g31 & b32 & r34 \end{bmatrix} \quad (9)$$

$$Im_3 = \begin{bmatrix} b11 & r13 & g14 \\ b21 & r23 & g24 \\ b31 & r33 & g34 \end{bmatrix} \quad (10)$$

$$Im_4 = \begin{bmatrix} r12 & g13 & b14 \\ r22 & g23 & b24 \\ r32 & g33 & b34 \end{bmatrix} \quad (11)$$

In this example, while each of the two-dimensional buffer memories 102 to 105 performs a writing by means of the horizontal scanning, each of the two-dimensional buffer memories 102 to 105 performs the vertical scanning during the next succeeding field since it utilizes the address outputted from the address generating circuit 107.

Also, since before the data writing, the reading of the data one field prior to the current field is carried out, the image data buffer memory 1 consequently outputs one column of data of the image data sequentially to the conversion block 100.

$$Im = \begin{bmatrix} r11 & g11 & b11 & r12 & g12 & b12 & r13 & g13 & b13 & r14 & g14 & b14 \\ r21 & g21 & b21 & r22 & g22 & b22 & r23 & g23 & b23 & r24 & g24 & b24 \\ r31 & g31 & b31 & r32 & g32 & b32 & r33 & g33 & b33 & r34 & g34 & b34 \end{bmatrix} \quad (12)$$

Figure 11:
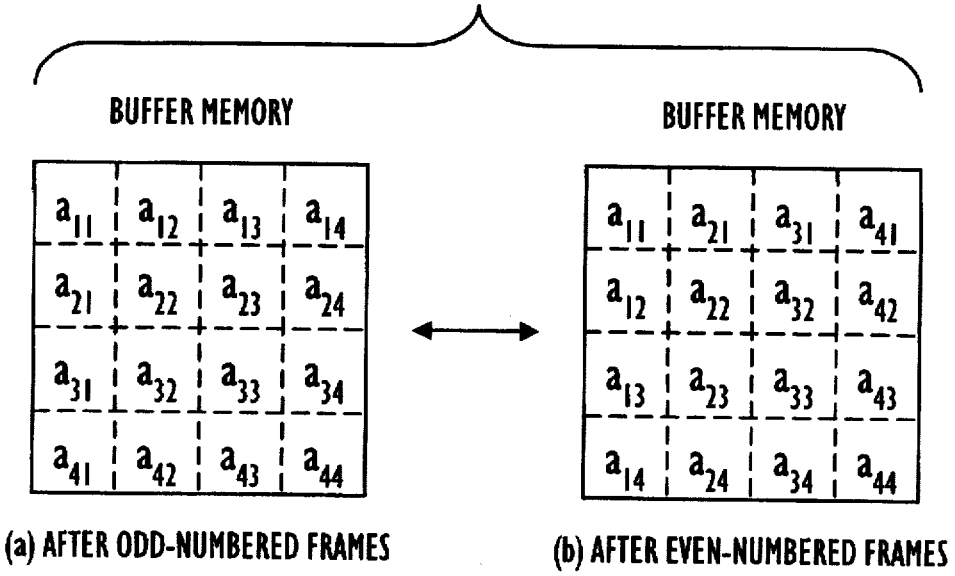
FIGS. 11(*a*) and (*b*) is a diagram showing the lay-out of the image data within a two-dimensional buffer memory forming the image data buffer memory.
Figure 12:
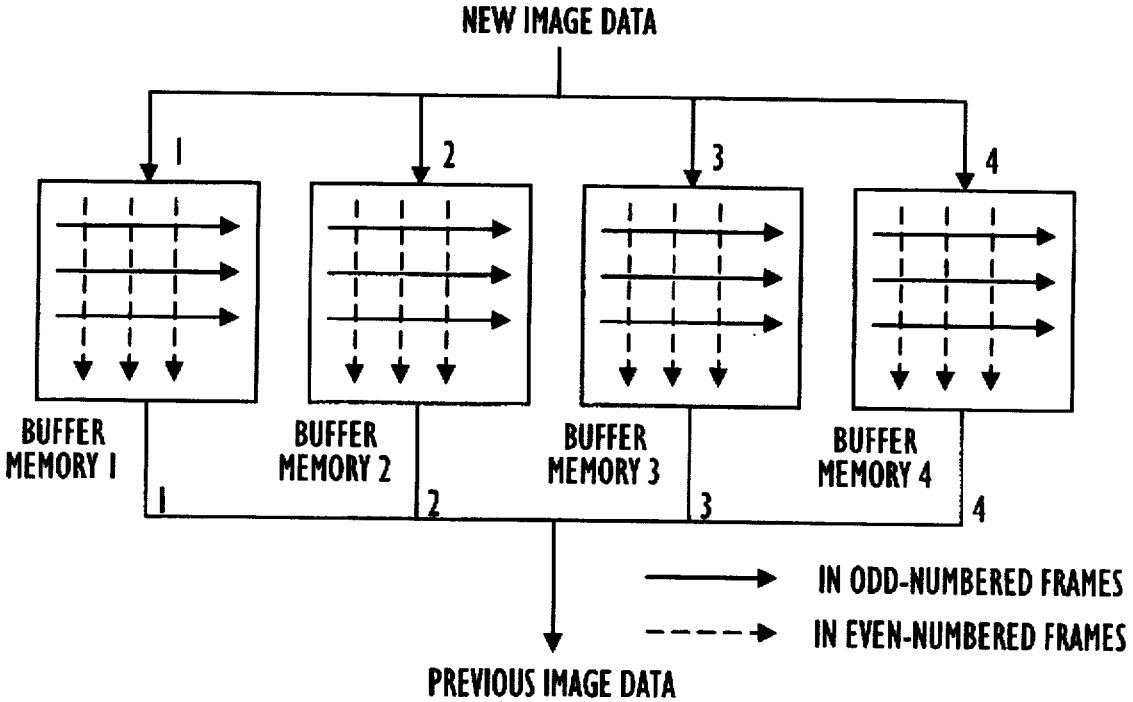
FIG. 12 is a diagram showing an operation of the image data buffer memory.

FIG. 11 illustrates how the image data are arranged in the two-dimensional memories forming such image data buffer memory 1. As shown in FIG. 11, in a condition similar to the definition of the rows and the columns in the two-dimensional buffer memories which has been reversed for each field period, the image data are stored. FIG. 12 illustrates the operation of the entire image data buffer memory 1. Referring to FIG. 12, the image data inputted are sequentially distributed to the two-dimensional buffer memories forming the image data buffer memory 1 and, in each of the two-dimensional buffer memories, the direction of operation is switched for each frame period to accomplish data reading and data writing simultaneously.

Hereinafter, the operation of the converted data buffer memory 7 will be described. Referring now to FIG. 10(*b*), a counter 708 outputs 0 to 3 repeatedly to a selector 701. Based on the output data from the counter 708, the selector 701 selects two-dimensional buffer memories 702, 703, 704 and 704 and then outputs the input data to the selected two-dimensional buffer memories. Each of the two-dimensional buffer memories 702 to 705 has a memory area of three rows and three columns and, before the data are written at a specified address, the data stored at such specified address are read out. An address generating circuit 707 generates an address necessary to permit the horizontal and vertical scannings to be repeated in the two-dimensional buffer memories for each field. A selector 706 operates, based on the output data from the counter 708, to select the two-dimensional buffer memories 702 to 705 and to cause output data to be outputted from the selected two-dimensional buffer memories.

The converted data, shown by the equation (13) below, which have been outputted from the conversion block 100 are outputted by means of the vertical scanning in the sequence of tr11, tr21, tr31, tg11, tg21, tg31, . . . and are, therefore, outputted to the two-dimensional buffer memories 702 to 705 in the form of respective data expressed by the following equations (14), (15), (16) and (17).

$$Tr = \begin{bmatrix} tr11 & tg11 & tb11 & tr12 & tg12 & tb12 & tr13 & tg13 & tb13 & tr14 & tg14 & tb14 \\ tr21 & tg21 & tb21 & tr22 & tg22 & tb22 & tr23 & tg23 & tb23 & tr24 & tg24 & tb24 \\ tr31 & tg31 & tb31 & tr32 & tg32 & tb32 & tr33 & tg33 & tb33 & tr34 & tg34 & tb34 \end{bmatrix} \quad (13)$$

$$Tr_1 = \begin{bmatrix} tr11 & tg12 & tb13 \\ tr21 & tg22 & tb23 \\ tr31 & tg32 & tb33 \end{bmatrix} \quad (14)$$

$$Tr_2 = \begin{bmatrix} tg11 & tb12 & tr14 \\ tg21 & tb22 & tr24 \\ tg31 & tb32 & tr34 \end{bmatrix} \quad (15)$$

$$Tr_3 = \begin{bmatrix} tb11 & tr13 & tg14 \\ tb21 & tr23 & tg24 \\ tb31 & tr33 & tg34 \end{bmatrix} \quad (16)$$

-continued $$Tr_4 = \begin{bmatrix} tr12 & tg13 & tb14 \\ tr22 & tg23 & tb24 \\ tr32 & tg33 & tb34 \end{bmatrix} \quad (17)$$

In this example, while each of the two-dimensional buffer memories 702 to 705 performs a writing by means of the vertical scanning, each of the two-dimensional buffer memories 702 to 705 performs the horizontal scanning during the next succeeding field since it utilizes the address outputted from the address generating circuit 707.

Also, since before the data writing, the reading of the data one field prior to the current field then written at such address is carried out, the image data buffer memory 7 consequently outputs one row of data of the image data, represented by the equation (13) above, sequentially to the D/A converter 8.

As hereinabove described, the image data buffer memory 1 even though it has a capacity equal to the size of the image data is possible to temporarily store the image data transferred by the horizontal scanning and then to read the image data out by the vertical scanning. The converted data buffer memory 7 even though it has a capacity equal to the size of the converted data is possible to temporarily store the converted data transferred by the vertical scanning and then to read the converted data out by the horizontal scanning.

At the same time, the image data buffer memory 1 compiles the R, G and B image data into a single image data and, therefore, arithmetic circuits (conversion block 100) for processing the R, G and B image data, respectively, can easily be unified into a single system.

It is to be noted that, if the data at the $N_1$-th column of the matrix $H_1$ outputted from the row register 12 are inputted to the virtual row forming circuit 3 and the virtual row forming circuit 3 reverses the sign of information of the virtual row when the data are "−1" (logic High) and then outputs it, similar effects can be obtained.

Also, in the adder network 5, even when L is not the power of 2, and if by suitably combining values of L and repeating a summation of the two values (L−1) times, the total of the L data can be calculated and, therefore, similar effects can be obtained.

Figure 13:
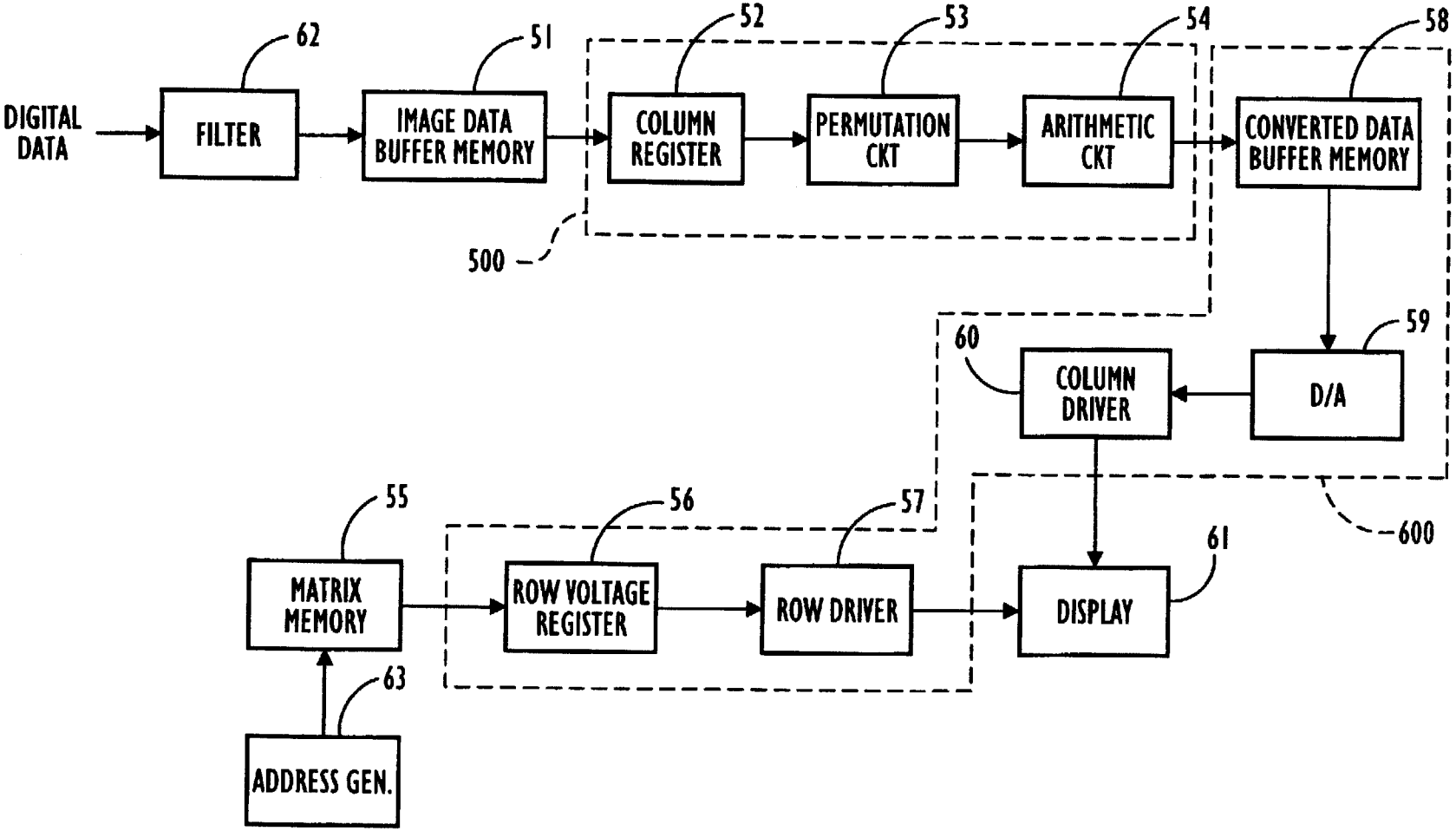
FIG. 13 is a circuit block diagram showing a second embodiment of the present invention.

Hereinafter, a second preferred embodiment of the present invention will be described with reference to the drawings. FIG. 13 is a circuit block diagram showing the structure according to the second embodiment of the present invention.

Referring to FIG. 13, a filter 62 is operable to emphasize a predetermined time-dependent frequency component at each pixel of digital time-varying image data inputted from an external circuit.

An image data buffer memory 51 stores the digital image data inputted from the external circuit and corresponding to one frame period ($N_2$ rows and M columns, $N_2$ represents a natural number) in the form of a matrix $A_2$ and then transfer the digital image data to a column register 52 in units of one column. A matrix memory 55 stores a matrix $H_2(n)'$ obtained from Walsh-Hadamard matrix $H_2(n)$ of $N_2$ rows and $N_2$ columns ($N_2=2^n$ and n represents a natural number).

A permutation circuit 53 connects the column register 52 and an arithmetic circuit 54 so that the sequence of the data stored in the column register 52 can be permuted and, therefore, after the permutation of the rows of the matrix $A_2$, it is transferred to the arithmetic circuit 54. The arithmetic circuit 54 utilizes a high speed computational technique for the Hadamard conversion with respect to the data of each column of the matrix $A_2'$ so that a matrix $B_2$ which is the product of the matrix $H_2(n)$ times the matrix $A_2'$.

A row voltage register 56 is operable to latch the u-th row of the matrix $H_2(n)'$ outputted from the matrix memory 55 at a timing u (u being a natural number not greater than $N_2$). A row driver 57 is operable to apply a voltage, corresponding to the data in the row voltage register 56, to row electrodes of the simple matrix type liquid crystal display 61.

On the other hand, the matrix $B_2$ calculated by the arithmetic circuit 54 for each column is temporarily stored in a converted data buffer memory 58. The converted data buffer memory 58 is operable to supply to a digital-to-analog (D/A) converter 59 all data of the matrix $B_2$ in the order from an intersection between the first row and the first column to the intersection between the first row and the M-th column and then down to the $N_2$-th row, which converter 59 subsequently converts the digital values, sequentially supplied from the converted data buffer memory 58, into corresponding analog values and then output those analog values. A column driver 60 is operable to apply to the M column electrodes of the simple matrix type liquid crystal display 61 voltages proportional to the analog values corresponding to the M data at the u-th row of the matrix $B_2$ which have been converted by the D/A converter 59 at the timing u.

Of these various component parts, the row voltage register 56, the row driver 57, the converted data buffer memory 58, the D/A converter 59 and the column driver 60 altogether constitute a drive block 600 for driving the simple matrix type liquid crystal display 61, and the column register 52, the permutation circuit 53 and the arithmetic circuit 54 altogether constitute a conversion block 500 for converting the matrix $A_2'$, whose rows have been permuted and stored in the image data buffer memory 51, into the matrix $B_2$ by the use of the high speed computation for the Hadamard conversion.

The nature of the matrix $H_2(n)'$ outputted from the matrix memory 55 will now be described. The matrix $H_2(n)$ is a matrix obtained from the following equation (18).

$$H_2(1) = \begin{bmatrix} 1 & 1 \\ 1 & -1 \end{bmatrix} \quad (18)$$

$$H_2(n) = \begin{bmatrix} H_2(n-1) & H_2(n-1) \\ H_2(n-1) & -H_2(n-1) \end{bmatrix}$$

If the frequency of change in sign of the data in each row of the matrix $H_2(n)$ is counted from one end to the opposite end in such row, and if the columns of this matrix H(n) are rearranged according to the magnitude of the frequency of change in sign, the following matrix $H_2(n)'$ can be obtained. It is to be noted that the half value of the frequency of change of the sign is called a sequency and corresponds to the frequency of the trigonometric function.

Assuming that n is 3 and $N_2$ is 8, the specific manner in which the matrixes $H_2(n)$ and $A_2$ are rearranged will be discussed. In the first place, if the columns of the matrix shown by the following equation (19) is rearranged in the order of the smallest sequency from left, the matrix represented by the equation (20) can be obtained.

$$H_2(3)=\begin{bmatrix}1&1&1&1&1&1&1&1\\1&-1&1&-1&1&-1&1&-1\\1&1&-1&-1&1&1&-1&-1\\1&-1&-1&1&1&-1&-1&1\\1&1&1&1&-1&-1&-1&-1\\1&-1&1&-1&-1&1&-1&1\\1&1&-1&-1&-1&-1&1&1\\1&-1&-1&1&-1&1&1&-1\end{bmatrix} \quad (19)$$

$$H_2(3)'=\begin{bmatrix}1&1&1&1&1&1&1&1\\1&1&1&1&-1&-1&-1&-1\\1&1&-1&-1&-1&-1&1&1\\1&1&-1&-1&1&1&-1&-1\\1&-1&-1&1&1&-1&-1&1\\1&-1&-1&1&-1&1&1&-1\\1&-1&1&-1&-1&1&-1&1\\1&-1&1&-1&1&-1&1&-1\end{bmatrix} \quad (20)$$

If arrangement of the m-the column of the matrix $H_2(n)$ into the m'-the column of the matrix $H_2(n)'$ is expressed by $m \rightarrow m'$ (m and m' being a natural number not greater than $N_2$), a method of this arrangement can be expressed as follows.

$$1\rightarrow1,\ 2\rightarrow8,\ 3\rightarrow4,\ 4\rightarrow5,\ 5\rightarrow2,\ 6\rightarrow7,\ 7\rightarrow3,\ 8\rightarrow6.$$

The permutation circuit 53 formulates the matrix $A_2'$ from the matrix $A_2$ in such a manner that the sequence of permutation is reverse to that when the matrix $H_2(n)'$ is formulated from the matrix $H_2(n)$. In other words, contrary to the case in which the m-the column of the matrix $H_2(n)'$ is rendered to be the m'-the column of the matrix $H_2(n)$, the m'-the row of the matrix $A_2$ is rendered to be the m-the row of the matrix $A_2'$. This method of permutation can be expressed as follow based on the method of expression discussed above.

$$1\rightarrow1,\ 8\rightarrow2,\ 4\rightarrow3,\ 5\rightarrow4,\ 2\rightarrow5,\ 7\rightarrow6,\ 3\rightarrow7,\ 6\rightarrow8.$$

The following equation (22) represents the matrix in which one column vector of such a matrix $A_2$ as expressed by the equation (21) is permuted according to the $(m'\rightarrow m)$ permutation method.

$$'[a_1\ a_2\ a_3\ a_4\ a_5\ a_6\ a_7\ a_8] \quad (21)$$

$$'[a_1\ a_8\ a_4\ a_5\ a_2\ a_7\ a_3\ a_6] \quad (22)$$

Figure 14:
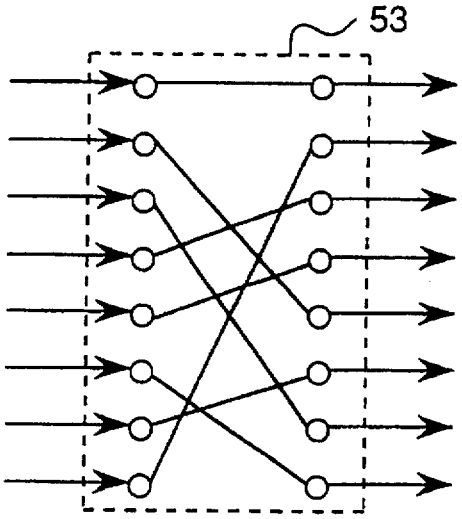
FIG. 14 is a block diagram showing the structure of a permutation circuit employed in the second embodiment shown in FIG. 13.

FIG. 14 illustrates the structure of the permutation circuit 53. When eight data of the equation (21) are passed through this circuit, permutation to the equation (22) can be achieved.

One column vector of the matrix $B_2$ obtained from the product between the column vectors of the equation (22) and the matrix $H_2(3)$ is shown by the following equation (23)

$$H_2(3)\begin{bmatrix}a_1\\a_8\\a_4\\a_5\\a_2\\a_7\\a_3\\a_6\end{bmatrix}=\begin{bmatrix}a_1&+a_8&+a_4&+a_5&+a_2&+a_7&+a_3&+a_6\\a_1&-a_8&+a_4&-a_5&+a_2&-a_7&+a_3&-a_6\\a_1&+a_8&-a_4&-a_5&+a_2&+a_7&-a_3&-a_6\\a_1&-a_8&-a_4&+a_5&+a_2&-a_7&-a_3&+a_6\\a_1&+a_8&+a_4&+a_5&-a_2&-a_7&-a_3&-a_6\\a_1&-a_8&+a_4&-a_5&-a_2&+a_7&-a_3&+a_6\\a_1&+a_8&-a_4&-a_5&-a_2&-a_7&+a_3&+a_6\\a_1&-a_8&-a_4&+a_5&-a_2&+a_7&+a_3&-a_6\end{bmatrix} \quad (23)$$

It will readily be seen that, when rewritten as shown by the equation (24), the column vector shown in the right of the equation (23) is the product between the matrix $H_2(3)'$ and the column vectors of the equation (21).

Accordingly, the equation (25) below establishes.

$$B_2=H_2(n)\cdot A_2'=H_2(n)'\cdot A_2 \quad (25)$$

In this way, where the Walsh function is employed for the orthogonal matrix, the high speed computing method for the $$\begin{bmatrix}a_1&+a_2&+a_3&+a_4&+a_5&+a_6&+a_7&+a_8\\a_1&+a_2&+a_3&+a_4&-a_5&-a_6&-a_7&-a_8\\a_1&+a_2&-a_3&-a_4&-a_5&-a_6&+a_7&+a_8\\a_1&+a_2&-a_3&-a_4&+a_5&+a_6&-a_7&-a_8\\a_1&-a_2&-a_3&+a_4&+a_5&-a_6&-a_7&+a_8\\a_1&-a_2&-a_3&+a_4&-a_5&+a_6&+a_7&-a_8\\a_1&-a_2&+a_3&-a_4&-a_5&+a_6&-a_7&+a_8\\a_1&-a_2&+a_3&-a_4&+a_5&-a_6&+a_7&-a_8\end{bmatrix}=H_2(3)'\begin{bmatrix}a_1\\a_2\\a_3\\a_4\\a_5\\a_6\\a_7\\a_8\end{bmatrix} \quad (24)$$

Hadamard conversion can be employed, making it possible to simplify the arithmetic circuit.

Figure 16:
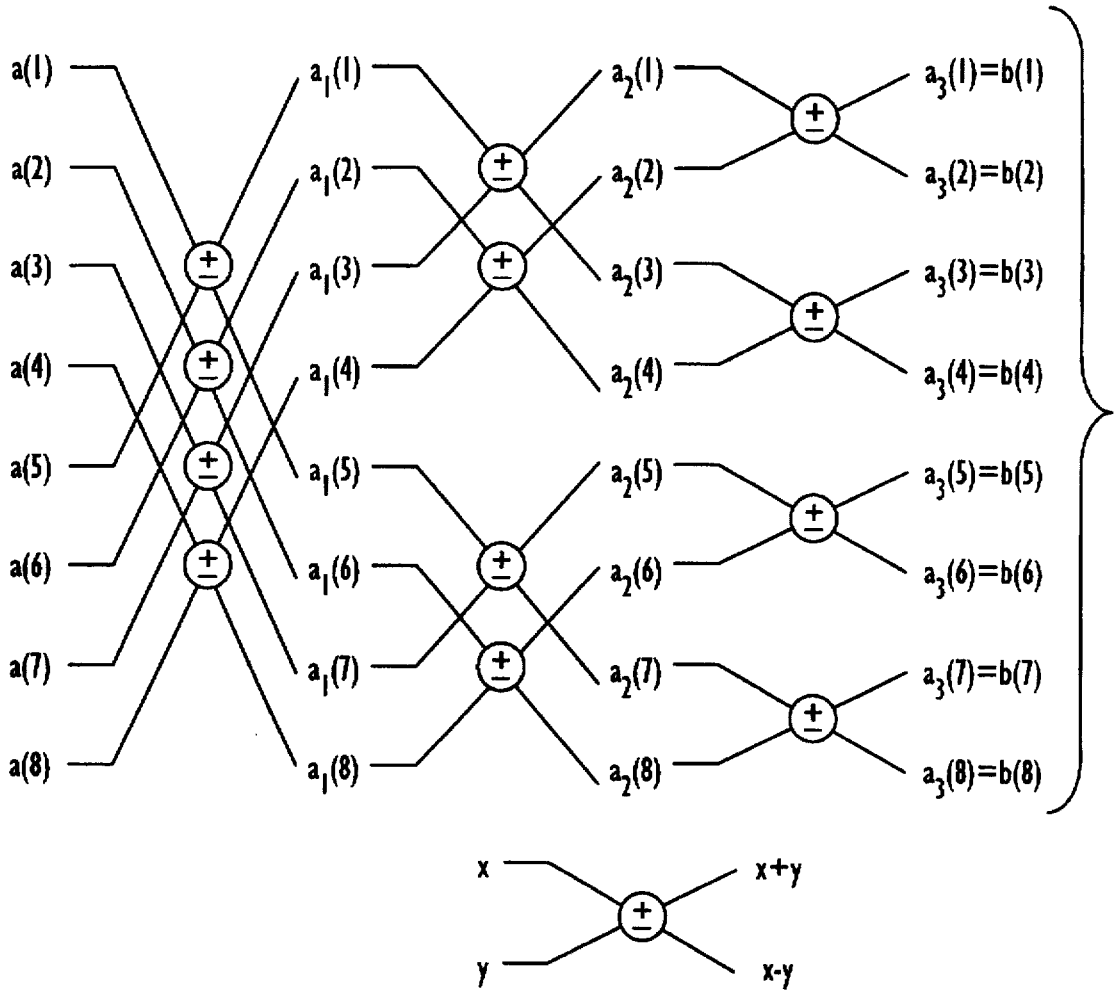
FIG. 16 is a flow chart showing a high speed computational method for the Hadamard conversion.

Also, A flow chart illustrative of the high speed computing method for the Hadamard conversion applicable when n and $N_2$ are taken as 3 and 8, respectively, is shown in FIG. 16. In FIG. 16, a(u) represents the u-th data in one column of the matrix $A_2$, and $a_1(k)$, $a_2(k)$ and $a_3(k)$ represent respective last-off results, $a_3(k)$ being taken as the k-th data b(k) in one column of the matrix $B_2$.

Hereinafter, a filter for emphasizing a frequency component for a predetermined time in each pixel of the time-varying image data will be described. Assuming that the frequency characteristic of the transmittance of light relative to a drive voltage applied to the liquid crystal display is a primary delay of a time constant T, the transfer function of this response can be expressed by the following approximate equation.

$$1/(1+\tau s) \quad (26)$$

The transfer function represented by the equation (26) can be rewritten as follows.

$$(1+\tau s)/(1+\gamma s) \quad (27)$$

Combining the equations (26) and (27) together results in the following equation which represents the nominal transfer function of the liquid crystal display.

$$1/(1+\gamma s) \quad (28)$$

In other words, when the time-varying image data processed by this filter is displayed on the liquid crystal display, the apparent response characteristic of the liquid crystal display represents a time constant $\gamma$. Therefore, if the filter is designed to achieve $\tau>\gamma$, the apparent response speed of the liquid crystal display can be increased.

The transfer function of this filter if designed in the form of a bilinear digital filter is expressed as follows.

$$H(z)=c\cdot(1+bz^{-1})/(1-az^{-1}) \quad (29)$$

wherein a, b and c are expressed as follows and T represents a frame period.

$$a=-(T-2\gamma)/(T+2\gamma) \quad (30)$$

$$a=(T-2\tau)/(T+2\tau) \quad (30')$$

$$a=(T+2\tau)/(T+2\gamma) \quad (30'')$$

Figure 15:
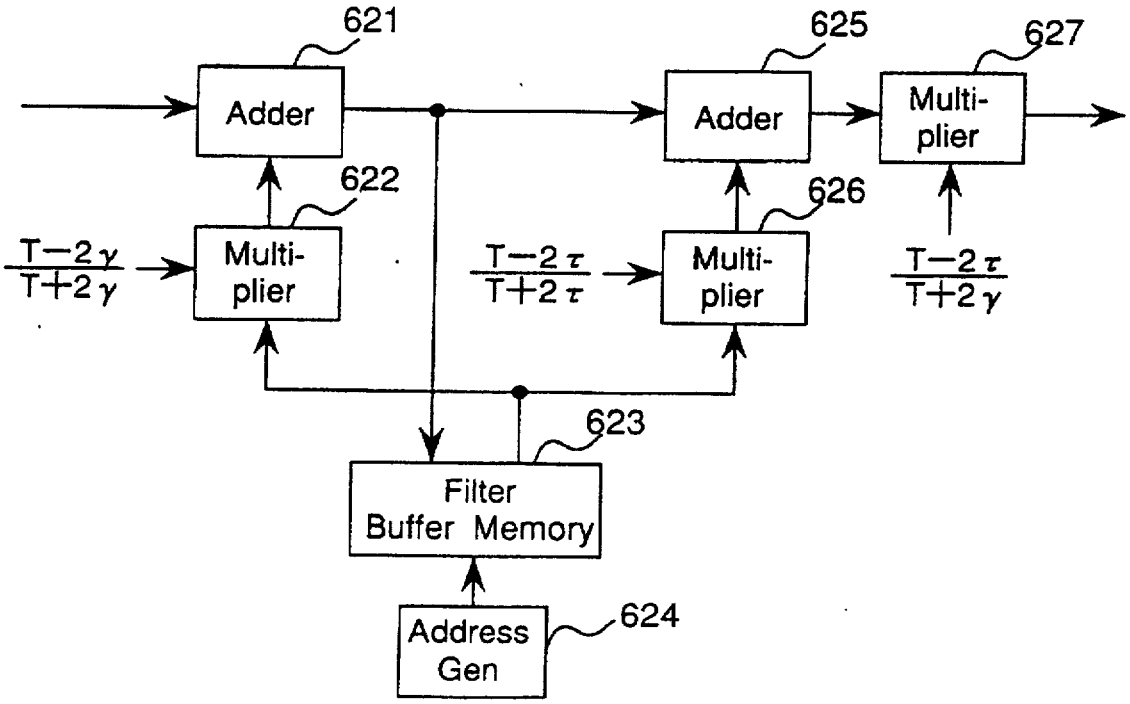
FIG. 15 is a block diagram showing the details of a filter employed in the second embodiment shown in FIG. 13.
Figure 17:
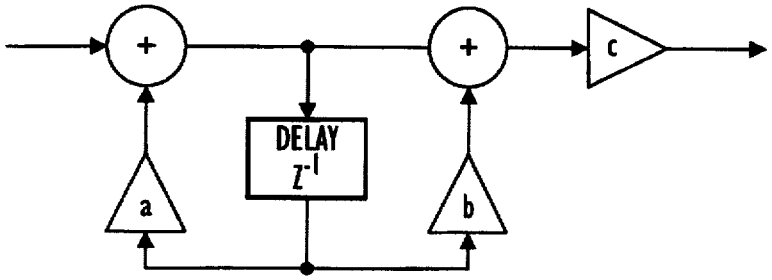
FIG. 17 is a block diagram showing the details of a bilinear digital filter.
Figure 18A:
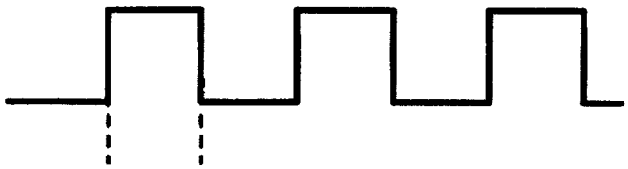
FIG. 18 is a timing chart showing how a filter employed in the second embodiment shown in FIG. 13 operates.
Figure 18B:
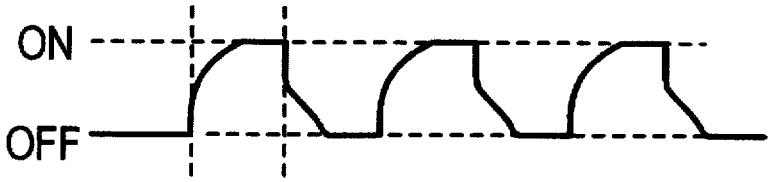
Figure 18C:
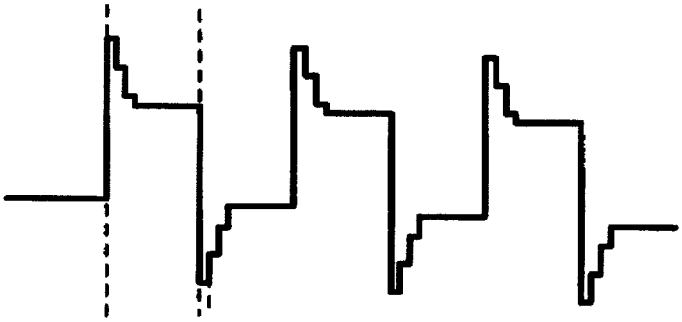
Figure 18D:
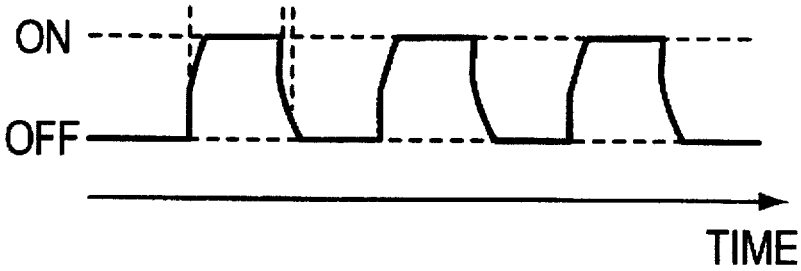

A filter 62 comprises, based on the structure shown in FIG. 17, such component elements as shown in FIG. 15. A filter buffer memory 623 has a capacity sufficient to hold the image data corresponding to one picture, and an address generating circuit 624 generates an address, in which data corresponding to one image data inputted from the external circuit, are written, and read the data out from the filter buffer memory 623. The filter buffer memory 623 and the address generating circuit 624 together correspond to a delay element shown in FIG. 17. An adder 621, a multiplier 622, an adder 625, a multiplier 626 and an adder 627 are operable to perform the arithmetic function of [r(h, i, j)=c·{p(h, i, j)+(a+b)·s(h, i, j)}], to transfer the processed image data to an image data buffer memory 51 and then to perform the arithmetic function of [s(h+1, i, j)=p(h, i, j)+a·s(h, i, j)] to rewrite the filter buffer memory 624. It is to be noted that r(h, i, j) represents the data at a pixel at the intersection between the i-th row and the j-th column of the input image data corresponding to the h-th picture (h being a natural number), r(h, i, j) represents data having been processed by the filter, and s(h, i, j) represents data at the intersection between the i-th row and the j-th column of the two-dimensional data accumulated in the delay element up until the (h−1) frame.

FIG. 18 illustrates a difference in change of the brightness of the liquid crystal display upon alternate application of ON and OFF voltages to the liquid crystal display, exhibited when the filter 62 is used and not used. A waveform (a) shown in FIG. 18 represents a change of the applied voltage when the filter 62 is not used; a waveform (b) represents a change in brightness of the liquid crystal display when the voltage shown by the waveform (a) is applied thereto; a waveform (c) represents a change in brightness of the applied voltage when the filter 62 is used; and a waveform (d) represents a change in brightness of the liquid crystal display when the voltage shown by the waveform (c) is applied thereto. As shown in FIG. 18, when the filter 62 is used, the response of the liquid crystal display can be improved from that shown by the waveform (b) to that shown by the waveform (d).

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A driving apparatus for a liquid crystal display having a layer of liquid crystal material capable of responding to a voltage applied to row and column electrodes, said apparatus comprising:

an image data buffer memory operable to perform, at a same location by switching a definition of rows and columns, functions of simultaneously writing said image data matrix in a plurality of areas and of reading said image data matrix, after R, G and B data have been combined together in an image data matrix corresponding to one frame of digital image data transferred from an external circuit;

matrix generating means for outputting a predetermined orthogonal matrix;

conversion means for converting said image data matrix into a converted data matrix using said orthogonal matrix, and for outputting said converted data matrix, said conversion means comprising an inverter group to calculate a 2's complement of a k-th data of a column of said image data matrix when a k-th data of a row of said orthogonal matrix is equal to −1;

a converted data buffer memory, having a plurality of two-dimensional memories, operable to perform, at a same location by switching a definition of rows and columns of each of said plurality of two-dimensional memories, functions of simultaneously writing converted data in said plurality of two-dimensional memories and of reading said converted data in said plurality of two-dimensional memories; and driving means utilizing said orthogonal matrix as a row signal to be applied to said row electrodes of said liquid crystal display and said converted data matrix as a column signal to be applied to said column electrodes of said liquid crystal display for driving said liquid crystal display by synchronizing said row signal and said column signal.

2. The driving apparatus as claimed in claim 1, wherein said image data buffer memory comprises:

a two-dimensional memory for said image data including a plurality of two-dimensional memories having a capacity having a size the same as a size of said image data matrix;

address generating means for outputting, in response to a vertical synchronizing signal, a set of row addresses and a set of column addresses by interchanging said row addresses and said column addresses with each other;

first selecting means for parallel transferring input data from said external circuit in said plurality of two-dimensional memories of said two-dimensional memory for said image data; and second selecting means for serially transferring to said conversion means, data which are parallel-outputted from said plurality of two-dimensional memories of said two-dimensional memory for said image data, said image data buffer memory operable to perform, at said same location, by switching a definition of rows and columns of each of said plurality of two-dimensional memories, functions of simultaneously writing said image data in said plurality of two-dimensional memories of said two-dimensional memory and of reading said image data in said plurality of two-dimensional memories of said two-dimensional memory, after R, G and B data corresponding to one frame period have been combined together.

3. The drive apparatus as claimed in claim 1, wherein said converted data buffer memory comprises:

a two-dimensional memory for said image data including a plurality of two-dimensional memories having a capacity having a size the same as a size of said image data matrix;

address generating means for outputting, in response to a vertical synchronizing signal, a set of row addresses and a set of column addresses by interchanging said row addresses and said column addresses with each other;

first selecting means for distributing said input data from said conversion means to said plurality of two-dimensional memories of said two-dimensional memory for said converted data; and second selecting means for serially transferring to said driving means, data which are parallel-outputted from said plurality of two-dimensional memories of said two-dimensional memory for said converted data, said image data buffer memory operable to perform, at said same location, by switching a definition of rows and columns of each of said plurality of two-dimensional memories, functions of simultaneously writing said converted data in said two-dimensional memory for said converted data and of reading said converted data.

4. A driving apparatus for a liquid crystal display having a layer of liquid crystal material capable of responding to a voltage applied to row and column electrodes, said apparatus comprising:

an image data buffer memory for storing and outputting image data corresponding to one frame period in a form of an image data matrix, said image data supplied from an external circuit;

matrix generating means for outputting a predetermined orthogonal matrix;

conversion means for converting said image data matrix into a converted data matrix using said orthogonal matrix, and for outputting said converted data matrix;

a converted data buffer memory for storing and outputting said converted data matrix; and driving means utilizing said orthogonal matrix as a row signal to be applied to said row electrodes of said liquid crystal display and said converted data matrix as a column signal to be applied to said column electrodes of said liquid crystal display for driving said liquid crystal display by synchronizing said row signal and said column signal with each other;

wherein said conversion means comprises virtual row forming means for calculating a value necessary to make constant, for all columns, a sum of the squares of data contained in one column of said image data matrix, said image data matrix comprising discrete values corresponding to real numbers ranging from 1 to −1, and for adding said calculated value virtually to a last row of said image data matrix as information for a virtual row; and arithmetic means for calculating a product of said image data matrix and said orthogonal matrix, said arithmetic means comprising an inverter group to calculate a 2's complement of a k-th data of a column of said image data matrix when a k-th data of a row of said orthogonal matrix is equal to −1;

wherein said virtual row forming means is operable to calculate information for said virtual row by reference to a predetermined table when all data for one column of said image data are outputted from said image data buffer memory to said arithmetic means; and wherein said arithmetic means calculates a product of said image data matrix and said orthogonal matrix, and adds to said product of said image data matrix and said orthogonal matrix said information for said virtual row, said product being one real number.

5. The driving apparatus for a liquid crystal display as claimed in claim 4, wherein said arithmetic means is operable, when a row dimension of said orthogonal matrix differs from a column dimension of said image data matrix, to add to said image data matrix rows in which data are zero, to adjust said row dimension of said orthogonal matrix to equal said column dimension of said image data matrix.

6. A driving apparatus for a liquid crystal display having a layer of liquid crystal material capable of responding to a voltage applied to row and column electrodes, said apparatus comprising:

an image data buffer memory for storing and outputting digital image data corresponding to one frame period in the form of an image data matrix, said digital image data supplied from an external circuit;

matrix generating means for outputting a predetermined orthogonal matrix;

conversion means for converting said image data matrix into a converted data matrix using said orthogonal matrix, and for outputting said converted data matrix;

a converted data buffer memory for storing and outputting said converted data matrix; and driving means utilizing said orthogonal matrix as a row signal to be applied to said row electrodes of said liquid crystal display and said converted data matrix as a column signal to be applied to said column electrodes of said liquid crystal display for driving said liquid crystal display by synchronizing said row signal and said column signal;

wherein said input image data supplied from said external circuit is interlaced image data;

wherein each said image data buffer memory and said converted data buffer memory stores data corresponding to one field;

wherein said conversion means comprises virtual row forming means for calculating a value necessary to make constant, for all columns, a sum of the squares of data contained in one column of said image data matrix, said image data matrix comprises discrete values corresponding to real numbers from 1 to −1, and for adding said calculated value virtually to a last row of said image data matrix as information for a virtual row; and arithmetic means for calculating a product of said image data matrix and said orthogonal matrix, said arithmetic means comprising an inverter group to calculate a 2's complement of a k-th data of a column of said image data matrix when a k-th data of a row of said orthogonal matrix is equal to −1;

wherein said virtual row forming means is operable to calculate information for said virtual row by making reference to a predetermined table when all data for one column of said image data are to be outputted from said image data buffer memory to said arithmetic means;

wherein said arithmetic means calculates a product of said image data matrix and said orthogonal matrix, and adds to said product of said image data matrix and said orthogonal matrix said information for said virtual row, said product being one real number; and wherein said driving means applies said row signal to a first neighboring two row electrodes of said liquid crystal display during an even-numbered field period, and applies said row signal to a second neighboring two row electrodes, differing by a value corresponding to one row with respect to said first neighboring two row electrodes, during an odd-numbered field period.

* * * * *

UNITED STATES PATENT AND TRADEMARK OFFICE

CERTIFICATE OF CORRECTION

PATENT NO. : 5,684,502

DATED : November 4, 1997

INVENTOR(S) : Y. FUKUI et al.

It is certified that error appears in the above-identified patent and that said Letters Patent is hereby corrected as shown below:

On the cover, in section [73], "Assignee", change "Tokyo" to ---Osaka --.

Signed and Sealed this

Third Day of November, 1998

*Attest:*

*Attesting Officer*

BRUCE LEHMAN

*Commissioner of Patents and Trademarks*